United States Patent [19]

Weldon et al.

[11] 3,961,155

[45] June 1, 1976

[54] THERMAL PRINTING ELEMENT ARRAYS

[75] Inventors: Lawrence A. Weldon, Harleysville, Pa.; Peter Bokalo, Metuchen, N.J.

[73] Assignee: Gulton Industries, Inc., Metuchen, N.J.

[22] Filed: June 24, 1974

[21] Appl. No.: 482,003

[52] U.S. Cl. ..... 219/216; 219/543; 338/307; 346/76 R

[51] Int. Cl.[2] ..... H05B 1/00

[58] Field of Search ..... 219/216, 543; 346/76 R; 338/307–309; 117/212, 215, 217, 227; 427/123, 126

[56] References Cited

UNITED STATES PATENTS

| | | | |
|---|---|---|---|
| 2,274,839 | 3/1942 | Marick | 219/301 X |
| 3,398,262 | 8/1968 | Kahn | 219/535 X |
| 3,478,191 | 11/1969 | Johnson et al. | 219/216 |
| 3,495,070 | 2/1970 | Zissen | 219/216 |
| 3,833,789 | 9/1974 | Taniguchi | 219/216 |

*Primary Examiner*—C. L. Albritton
*Attorney, Agent, or Firm*—Darby & Darby

[57] ABSTRACT

An array of elongated thermal printing elements which may be selectively energized through suitable electrodes connected to the long dimension of the thermal printing elements to thermally print numeric characters or other information.

12 Claims, 4 Drawing Figures

THERMAL PRINTING ELEMENT ARRAYS

This invention relates to thermal printing element arrays and, more particularly, to arrays of elongated thermal elements.

One type of conventional thermal printing element array includes seven elongated thermal elements arranged in the form of a squared-off figure 8. By selective energization of the individual thermal elements, the numeric characters 0 through 9 can be formed by such an array. Printing is accomplished by placing the printing element array in contact with a thermally sensitized medium, such as thermographic paper, and electrically energizing the necessary thermal elements to produce the desired character. The temperature rise due to $I^2R$ heating of the element causes a color change in the thermally sensitive medium. Electrical energization of the thermal elements is accomplished by electrodes which are conventionally connected to the ends of the elongated thermal elements.

One disadvantage of the conventional end-terminated seven-element array is that excessively wide gaps appear in the printed pattern at the ends of the thermal elements because of the need for spacing between the electrodes for purposes of electrical isolation and because no significant heating takes place in the connection area where the resistive thermal element overlaps the conductive electrode. The result is a printed pattern which has poor esthetic appeal and poor legibility for the small character sizes required by many applications.

Another disadvantage of conventional thermal printing element arrays is that all resistor elements must be designed to be of equal length in order to attempt to achieve equal power densitites and thus uniform printing. Hence, conventional end-terminated thermal printing arrays are limited to patterns in which all thermal elements are of equal length.

Another disadvantage of the conventional end-terminated thermal printing element arrays is that reliability is relatively poor because the electrical energizing current is forced to flow through the smallest cross-sectional area of the resistive element. Any irregularity in the cross-sectional area of the resistive element or any non-homogeneity in the resistive material itself will constrict the flow of current and thus produce areas of high current density resulting in "hot spots." Excessive temperatures as such hot spots will eventually cause decomposition and/or fracturing of the resistive material and subsequent failure of the element.

Still another disadvantage of the conventional thermal printing element arrays is that the cumulative effects of such factors as non-homogeneity of the resistance material and irregularity in the cross-sectional areas of the resistive elements cause large variations in the total resistance of each resistive thermal element of the array. Because economics dictate that all of the thermal elements in a particular array be excited from a common voltage, variations in total resistance from element to element cause temperature differences which result in lack of uniformity of printing density.

It is therefore an object of this invention to provide improved thermal printing element arrays which obviate the problems of the prior art.

It is also an object of this invention to provide thermal printing element arrays having improved reliability.

It is another object of this invention to provide thermal printing element arrays having improved uniformity of printing density.

It is still another object of this invention or provide thermal printing element arrays having improved legibility in the smaller character sizes.

According to the above and other objects, the present invention provides an array of elongated thermal printing elements in which the electrodes are connected to the sides or top and bottom of the thermal elements.

An advantage of the thermal printing array of the present invention is that they may be designed with thermal elements of different lengths so as to improve the esthetic appeal of the printed characters.

Other objects and advantages of the present invention will be apparent from the following detailed description and accompanying drawings which set forth, by way of example, the principle of the present invention and the best mode contemplated for carrying out that principle.

Figure 1:
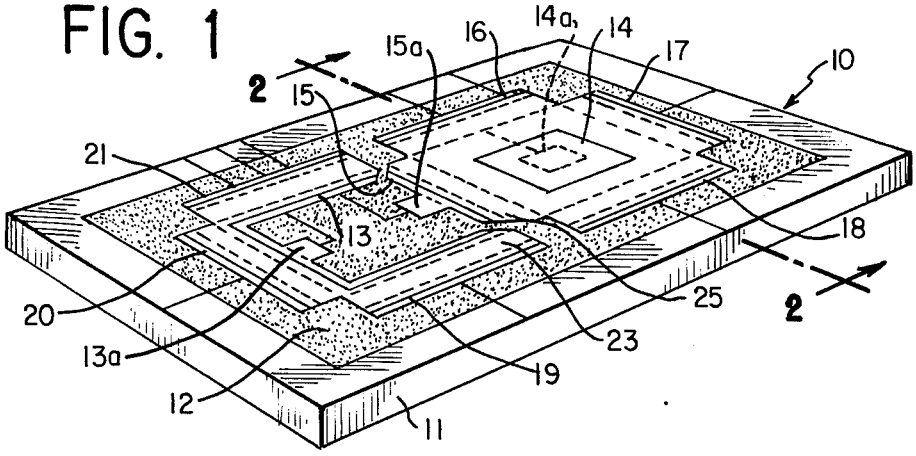
FIG. 1 is a perspective view, larger-than-life-size, of a thermal printing element array according to the present invention in which the electrodes are connected to the sides of the elongated thermal printing elements.
Figure 2:
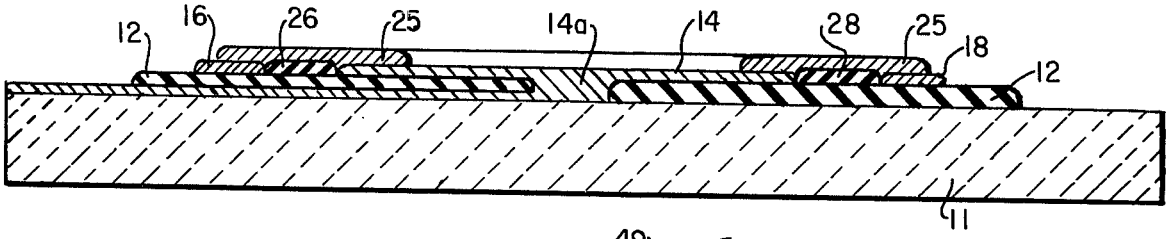
FIG. 2 is an enlarged cross-sectional view taken along the line 2—2 of FIG. 1.

Referring in detail to FIGS. 1 and 2 of the drawings, there is shown a seven-element thermal printing array in which the energizing conductors are connected to the sides of the elongated thermal elements in accordance with the present invention. The thermal printing element array, generally designated 10, is constructed on a substrate 11 which serves as a base member and heat sink. Substrate 11 is preferably made of alumina ceramic or other suitable material. While the thickness of substrate 11 is not critical, a thickness of about 15 to 25 mils is suitable for most applications.

Various layers of conductive material, resistive material and insulative material are laid down upon the substrate 11 through suitably delineated masks by well known thick film process or by thin film deposition and etching techniques. For purposes of illustration, thick film embodiments will be described.

Layer 12 is an isolation layer preferably made of ceramic glass dielectric or other suitable material which may be screened onto substrate 11 and fired at a high temperature to fuse it in place. Isolation layer 12 serves to electrically isolate the resistive thermal elements and conductor materials from the underlying conductor material. The thickness of the isolation layer 12 determines the time required for the heat developed in the resistive thermal elements to be dissipated into the heat sink 11. In the preferred form of the present invention, isolation layer 12 is about 1 to 1-½ mils thick, in order to accomplish heat dissipation in a relatively short time, for example 1 to 3 milliseconds, and provide the required electrical isolation.

Electrodes 13, 14, 15, 16, 17, 18, 19, 20 and 21 are preferably made of cermet gold or other suitable glass-metal frit or other material and are screened onto the separate areas shown through a suitable mask and then fired to fuse them in place. Electrodes 13 and 14 are common electrodes and the remaining electrodes 15-21 are associated with individual thermal printing elements. The conductive leads to electrodes 13, 14 and 15 pass beneath the isolation layer 12 and are connected to the electrodes 13, 14 and 15 through the conductor vias 13a, 14*a* and 15*a* respectively. In the preferred embodiment, the conductive layer is about 0.3 mils thick.

A resistive layer, preferably cermet resistor or other suitable material, is screened over the electrodes 13-21 in areas 23 and 25 defined by a suitably delineated mask. However, before the resistive layer 23, 25 is laid down, an additional isolation layer is often deposited in the areas between the common electrodes 13 and 14 and individual electrodes 15-21 such as, for example, areas 26 and 28 between common electrode 14 and individual electrodes 16 and 18 respectively as shown in FIG. 2. The dielectric material of isolation layer 26, 28 serves to elevate the resistive layer 23, 25 in the areas between the conductive electrodes. In the preferred embodiment, the resistive layer 23, 25 is about 1-½ mils thick.

In operation, the common electrodes 13 and 14 of the thermal printing element array of FIG. 1 are connected to a common potential, for example, ground potential, and the individual electrodes 15-21 are selectively energized to heat their associated areas of the resistive layer 23, 25. For example, referring to FIG. 2, if electrode 18 is energized, the resistive layer 25 immediately above isolation layer 28 will become heated. Similarly, if electrode 16 is energized the resistive layer 25 immediately above isolation layer 26 will become heated.

The duration of the electrical energizing pulses used in the operation of the subject thermal printing arrays depend upon the electrical power density that can be tolerated by the structure. In the preferred embodiment of the present invention pulse widths are on the order of 5 milliseconds and power density is on the order of 1.2 kilowatts per square inch. It will be appreciated by those skilled in the art that care must be taken to match the thermal properties of the various thick film layers of the device so as to avoid damage due to differential heat expansion.

Figure 3:
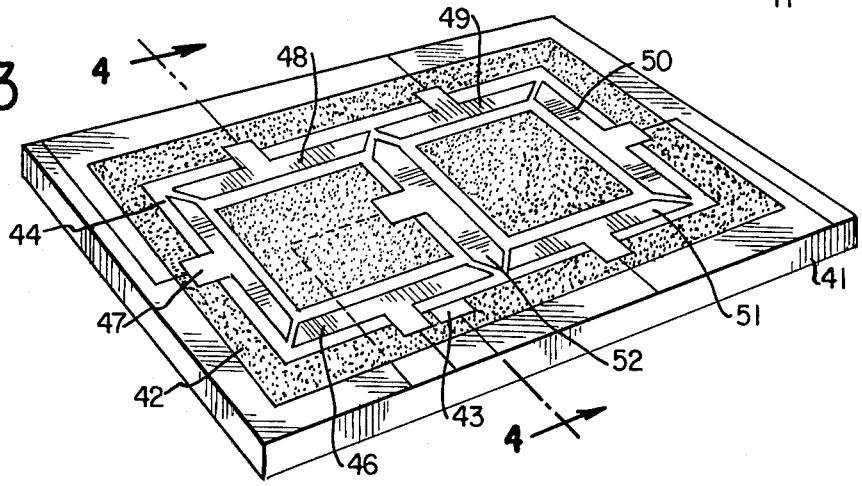
FIG. 3 is a perspective view, larger-than-life-size, of a thermal printing element array according to the present invention in which the electrodes are connected to the top and bottom of the thermal printing elements.
Figure 4:
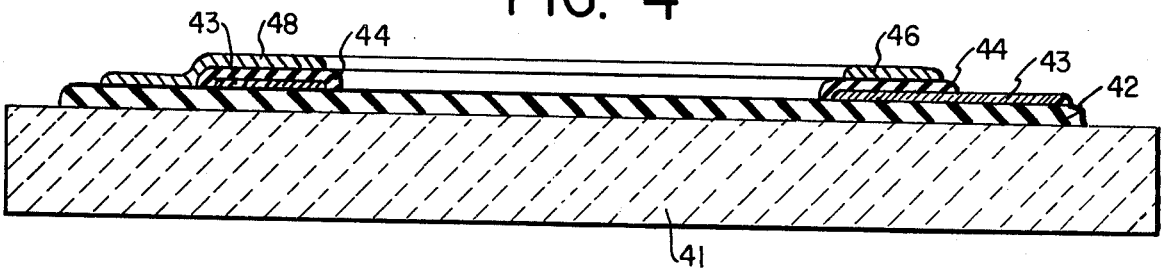
FIG. 4 is an enlarged cross-sectional view taken along the line 4—4 of FIG. 3.

Referring to FIGS. 3 and 4 of the drawings there is shown an embodiment of a thermal printing element array according to the present invention in which the energizing electrodes are connected to the top and bottom of the elongated thermal printing elements. As in the embodiment of FIGS. 1 and 2, the thermal printing array, generally designated 40, is mounted on a substrate 41 which acts as a heat sink and is preferably made of alumina ceramic and is about 15 to 25 mils thick. An isolation layer 42, preferably made of ceramic glass dielectric about 1 to 1-½ mils thick, is screened onto the substrate 41. Isolation layer 42 electrically isolates the printing elements from the underlying conductors and controls the rate at which heat is dissipated from the printing elements into the heat sink 41.

An electrically conductive layer 43 is then screened onto the isolation layer 42 through a suitably delineated metal screen mask. Conductive layer 43 is preferably made of cermet gold or silver-palladium about 0.3 mils thick, and serves as the common electrode for the thermal printing element array.

A resistive layer 44 is then screened over the conductor 43. Resistive layer 44 is preferably made of cermet resistor material about 1-½ mils thick. The areas of resistive layer 44 that are subjected to the flow of electrical current serve as the heating elements for the thermal printing array.

The individual top electrodes 46, 47, 48, 49, 50, 51 and 52 are screened on top of the resistive layer 44 through a suitably delineated mask. As in the case of the bottom common electrode 43, the top individual electrodes 46-52 are preferably made of cermet gold about 0.3 mils thick. Conductor 52 is connected to its source of energizing potential through a conductor via 52*a*.

As in the case of the side terminated thermal printing array of FIGS. 1 and 2, the top and bottom terminated thermal printing array of FIGS. 3 and 4 is caused to produce the desired thermal printing pattern by selective energization of the individual electrodes 46-52. The heat produced by the flow of electrical current through the selected portions of resistive layer 44 is transmitted through the energized top conductor to the thermographic medium.

Both the side terminated configuration of FIGS. 1 and 2 and the top and bottom terminated configuration of FIGS. 3 and 4 have the advantage of improved esthetic quality and legibility over the prior art end-terminated thermal printing arrays. The effective spacing between the ends of the thermal elements is greatly reduced thus providing improved legibility of smaller size characters. In addition, both the side terminated configuration of FIGS. 1 and 2 and the top and bottom terminated configuration of FIGS. 3 and 4 provide for greater versatility in the esthetic design of the thermally printed characters because the individual thermal printing elements need not be of equal length in order to achieve uniform printing density.

Further, both the side terminated thermal printing array of FIGS. 1 and 2 and the top and bottom terminated thermal printing array of FIGS. 3 and 4 provide improved reliability because the cross-sectional area of resistive material normal to the direction of current flow is far greater than in the case of end terminated elements with the result that variations in the thickness of the resistive layer and non-homogeneity of the resistor material create less severe constrictions of the electrical current flow, thus reducing "hot spots" which tend to decompose and/or fracture the resistor material and thereby cause its failure.

In addition, such variations in the thickness of the resistor layer and anomalies in the resistor material have only local effects on the current flow and do not produce great variations in the total resistance of the printing elements. As a result, such anomalies in the resistor material have a less significant effect on the overall uniformity of printing density.

Although the thermal printing arrays of FIGS. 1–4 use thick film technology, it will be appreciated that thin film technology, in which the various layers are laid down by vapor deposition, may also be employed within the spirit of the present invention. For example, if thin film techniques are used, the isolation layers may be made of silane glass or silicon dioxide or the like, the conductive layers may be made of gold or other highly conductive materials and the resistive layers may be made of nichrome or tantalium metal or the like.

It will also be appreciated that the size and shape of the thermal printing element can be modified within the spirit and scope of the present invention. While in the preferred embodiment the thermal element array is about 150 mils high by 90 mils wide, larger or smaller arrays may be used. Similarly, arrays having a larger or smaller number of thermal elements arranged in different patterns may be used in various applications. For example, an array of four thermal elements arranged in square may be used to print the numeric characters 0 through 9 by moving the thermographic paper a half step between exposures so as to allow the square array to successively print the top and bottom halves of the character.

While the principles of the present invention have been illustrated by reference to preferred embodiments of thermal printing element arrays, it will be appreciated by those skilled in the art that various modifications and adaptations of the preferred embodiments may be made without departing from the spirit and scope of the present invention as set forth with particularity in the appended claims.

What is claimed is:

1. A thermal printing element array for printing selected symbols on a thermographic recording medium comprising:

a substrate member;

a plurality of elongated resistive elements supported by said substrate member, said resistive elements being arranged in a pattern so that selective electrical energization of said resistive elements will cause selected symbols to be thermally printed on a thermographic recording medium placed in cooperative relation with said resistive elements; and a plurality of electrical conductors supported by said substrate member, each of said resistive elements being electrically connected to a pair of said electrical conductors, and each of said electrical conductors being connected along the long dimension of a respective one of said elongated resistive elements so that electrical current path between said conductors is across the short dimensions of said resistive elements.

2. The thermal printing element array of claim 6 further comprising:

an isolation layer disposed between said substrate and said resistive elements.

3. The thermal printing element array of claim 1 wherein each said pair of electrical conductors are connected to a respective elongated resistive element along opposite sides thereof.

4. The thermal printing element array of claim 3 wherein a single electrical conductor is connected to one side of each of a plurality of resistive elements, the opposite side of each of said plurality of resistive elements being connected to an individual electrical conductor.

5. The thermal printing element array of claim 3 wherein said electrical conductors comprise a layer of separate areas of electrically conductive material, pairs of areas of electrically conductive material defining the longitudinal edges of elongated spaces therebetween.

6. The thermal printing element array of claim 5 wherein said resistive elements comprise layers of areas of resistive material bridging said elongated spaces between said pairs of areas of electrically conductive material.

7. The thermal printing element array of claim 2 wherein said layer of separate areas of conductive material is superposed over said isolation layer and said layer of areas of resistive material is superposed over said layer of areas of conductive material.

8. The thermal printing element array of claim 2 wherein said electrical conductors are connected to the top and bottom of said elongated resistive elements.

9. The thermal printing element array of claim 8 wherein said plurality of electrical conductors comprises a first layer of electrically conductive material serving as a common electrode for said elongated resistive elements and a second layer of separate elongated areas of electrically conductive material serving as individual electrodes for said resistive elements.

10. The thermal printing element array of claim 9 wherein said resistive elements comprise a layer of resistive material disposed between said first and second layers of electrically conductive material.

11. The thermal printing element array of claim 10 wherein said first layer of electrically conductive material is superposed over said isolation layer, said layer of resistive material is superposed over said first layer of electrically conductive material and said second layer of electrically conductive material is superposed over said layer of resistive material.

12. A thermal printing element array for printing selected symbols on a thermographic recording medium comprising:

a substrate member;

a plurality of elongated resistive elements supported by said substrate member, said resistive elements being arranged in a pattern so that selective electrical energization of said resistive elements will cause selected symbols to be thermally printed on a thermographic recording medium placed in cooperative relation with said resistive elements; and a plurality of electrical conductors supported by said substrate member, each of said resistive elements being electrically connected to a pair of said electrical conductors, and each of said electrical conductors being connected along the long dimension of a respective one of said elongated resistive elements so that electrical current path between said conductors is across the short dimensions of said resistive elements, at least one of said conductors being connected along the long dimensions of at least two resistive elements in common.

* * * * *